US006883673B1

(12) United States Patent
Gourley

(10) Patent No.: US 6,883,673 B1
(45) Date of Patent: Apr. 26, 2005

(54) TABLE TRAY

(76) Inventor: Mervin D. Gourley, 9312 Burnet Ave., North Hills, CA (US) 91343

( * ) Notice: Subject to any disclaimer, the term of this patent is extended or adjusted under 35 U.S.C. 154(b) by 179 days.

(21) Appl. No.: 10/267,146

(22) Filed: Oct. 8, 2002

(51) Int. Cl.[7] ..... B65D 91/00

(52) U.S. Cl. ..... 220/4.24; 220/475; 220/553; 220/23.4; 108/94

(58) Field of Search ..... 220/4.24, 475, 220/553, 23.4, 23.83; 108/9.4

(56) References Cited

U.S. PATENT DOCUMENTS

| | | | | |
|---|---|---|---|---|
| 1,155,638 A | | 10/1915 | Bowen | |
| 2,566,804 A | * | 9/1951 | La Flamme et al. | 220/699 |
| 2,589,719 A | | 3/1952 | McKinney | 311/110 |
| 3,473,754 A | * | 10/1969 | Quenot | 242/405 |
| 4,521,464 A | * | 6/1985 | Chapman | 428/33 |
| 4,708,256 A | | 11/1987 | Intardonato | 220/23.4 |
| 4,739,894 A | * | 4/1988 | Pender | 220/23.4 |
| 5,294,012 A | * | 3/1994 | Shott et al. | 220/23.4 |
| 5,322,023 A | | 6/1994 | Hammond | 108/50 |
| 5,335,803 A | | 8/1994 | Obrien | 211/163 |
| 5,493,976 A | | 2/1996 | Hammond | 108/50 |
| 5,522,514 A | | 6/1996 | Robinson | 211/188 |
| 5,803,265 A | | 9/1998 | Bergerman | 206/557 |
| 5,848,712 A | | 12/1998 | Weir | 211/107 |
| 5,934,634 A | | 8/1999 | Lindblom | 248/230.1 |
| 6,280,874 B1 | * | 8/2001 | Hensley et al. | 429/88 |
| 6,382,452 B1 | * | 5/2002 | Getachew et al. | 220/524 |

* cited by examiner

*Primary Examiner*—Joseph Man-Fu Moy
(74) *Attorney, Agent, or Firm*—Dennis W. Beech

(57) ABSTRACT

The table serving tray may be a pair of tray elements that are interlocked together at an adjoining wall portion of a wall that is attached to a base. The adjoining wall portion of each tray may have an approximately semicircular cross section lip interlocking element on a portion of an upper edge of the adjoining wall portion. Each adjoining wall portion may have a centrally disposed channel that form a hole when the pair of tray elements are interlocked to place the tray on a table and around an upstanding projection thereof.

9 Claims, 2 Drawing Sheets

1A
1A
10
12
14
16
20
22
23
24
25
26
27
28
30
32
34
40
42
52

TABLE TRAY

BACKGROUND OF THE INVENTION

This invention relates to devices for use on tables to hold food items such as condiments in the center of the table for rotation for ease of access to the food items. The new table serving tray may be placed around an upstanding projection in a table such as an umbrella pole and be placed on a pad having a bearing assembly to facilitate rotation.

Serving trays for use on tables having upstanding projections are known in the art. They may have a radial slot to facilitate placement around a pole such as for an umbrella. The serving tray may also be formed in two halves to be connected as for example in U.S. Pat. No. 4,708,256, issued Nov. 24, 1987. Trays may also have interior walls to form additional compartmentalization of the tray. The known devices for table trays do not include a simple symmetrical tray half design that may allow simple manufacture as well as other elements of the invention.

SUMMARY OF THE INVENTION

The present invention is a tray for use on a table having an upstanding projection that may be placed around the upstanding projection and may be rotated thereround. The serving tray may be a pair of tray elements that are interlocked together at an adjoining wall portion of a wall that is attached to a base. The adjoining wall portion of each tray may have an approximately semicircular cross section lip as an interlocking element on a portion of an upper edge of the adjoining wall portion. Each adjoining wall portion may have a centrally disposed channel that forms an aperture when the pair of tray elements are interlocked.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figures 1, 1A, 2, 3, 5:
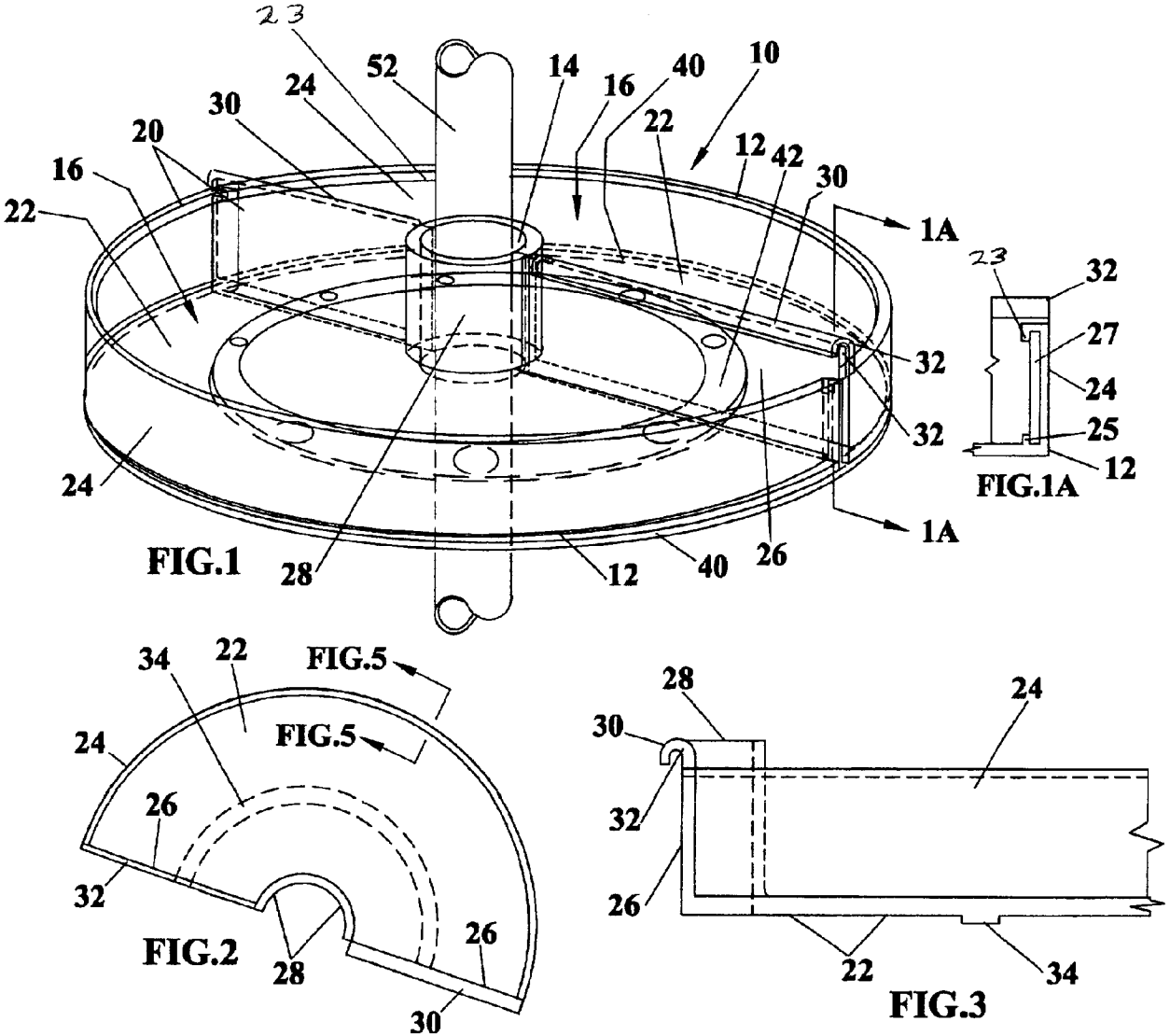
FIG. 1 illustrates a top perspective view of the serving tray and bearing assembly pad.
FIG. 1A illustrates a sectional view taken at 1A in FIG. 1.
FIG. 2 illustrates a top view of a tray element.
FIG. 3 illustrates a side elevation view of a tray element.
FIG. 5 illustrates a cross sectional view taken at A—A in FIG. 2 of the outer wall and base.
Figure 5:
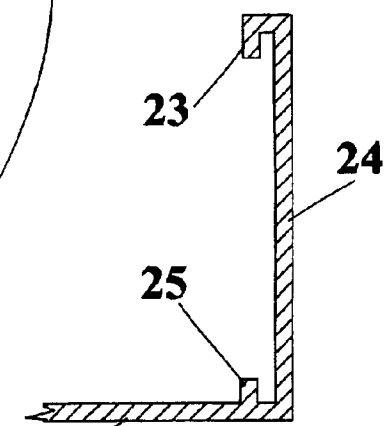
Figure 4:
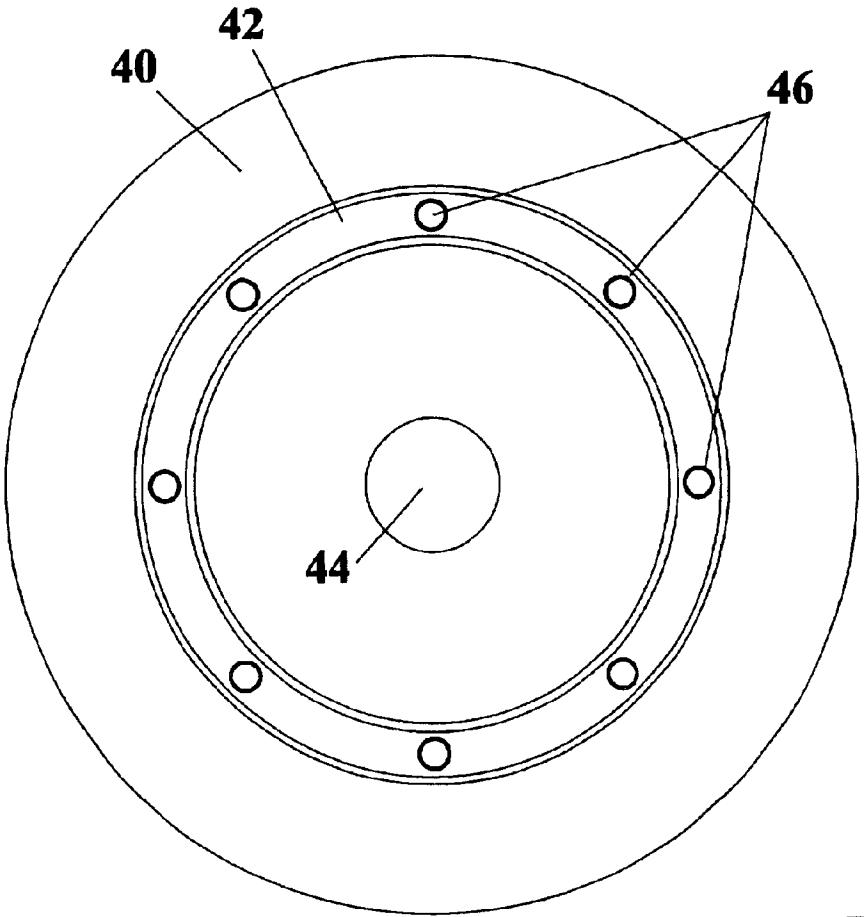
FIG. 4 illustrates a top view of the bearing assembly pad.

Referring to FIG. 1, a serving tray 10 may have two approximately semicircular tray elements 12 interlocked to form a generally circular serving tray 10 having an aperture 14 formed therein. The two tray elements 12 may form two compartments 16. The tray 10 may be placed on a table (not shown) around an upstanding projection 52, such as, an umbrella pole and the like. The tray 10 may also be placed on a bearing assembly pad 40 for ease of rotating the tray 10 for access to items, such as, condiments, placed in the tray 10. While a generally circular tray 10 is illustrated and described, it may be understood that other outer peripheral shapes, such as, hexagonal, octagonal and the like, may be used for tray 10.

Referring to FIGS. 1 through 3, the tray 10 tray elements 12 may have a wall 20 attached to a base 22. The wall 20 may have an outer wall portion 24 of generally annular shape and an adjoining wall portion 26 that is generally straight. The adjoining wall portion 24 may have a centrally disposed partially curved portion forming a channel 28 that when mated with a second channel 28 forms aperture 14. The outer wall portion 24 and adjoining wall portion 26 may be of relative equal height or of differing height as illustrated in FIG. 3. The tray 10 is illustrated as formed of transparent plastic, however, other materials may be used.

The outer wall portion 24 may have provision for insertion or attachment of bands of advertising material. Referring to FIGS. 1A and 5, an outer wall portion 24 may be formed in a reverse "C" configuration wherein the outer wall portion 24 may have an upper retainer projection 23 and a lower retainer projection 25. The lower retainer projection 25 may also be formed as part of the base 22. The retainer projections 23, 25 may be tabs spaced around the outer wall portion 24, may be continuous annular lips around the outer wall portion 24 and the base 22, or like structures. A band of advertising material (not shown) may be inserted against the interior of outer wall portion 24 through slot 27, as best viewed in FIG. 1A, and may be retained in place by the retainer projections 23, 25.

The adjoining wall portion 26 of each tray 10 may have an approximately semicircular cross section lip 30 as an interlocking element attached on a portion of an upper edge 32. One tray element 12 may be interlocked to a second tray element 12 by engaging the lips 30 of each with a portion of the upper edge 32 of each tray element 12. The upper edges 32 of each may be frictionally engaged, snap fit or the like attachment to the lip 30 of the opposed tray element 12.

Referring to FIGS. 1 through 4, the tray element 12 may have an annular rail 34 on the bottom of the base 22. This annular rail 34 may be located to mate with an annular bearing assembly 42 attached to a pad 40. The pad 40 may be formed of a cushioned material such as rubber, soft plastic or the like and may have an aperture 44. The bearing assembly 42 may be of plastic or other suitable structure with provision to incorporate ball bearings 46 such that they may rotate when force is exerted to rotate tray 10 thereby applying force of rail 34 to move on the ball bearings 46.

While the invention has been particularly shown and described with respect to the illustrated embodiments thereof, it will be understood by those skilled in the art that the foregoing and other changes in form and details may be made therein without departing from the spirit and scope of the invention.

I claim:

1. A device to hold food items on a table having an upstanding projection therefrom comprising:

a pair of tray elements wherein each tray element having an interlocking element of an approximately semicircular cross section lip on a first portion of an upper edge of an adjoining wall portion of a wall attached to a base;

said adjoining wall portion having a centrally disposed channel that forms an aperture when said tray elements are interlocked;

said device assembled by interlocking said channel interlocking element of each of said tray elements to a second portion of said upper edge; and an outer wall portion of said wall attached to said base forming a compartment and said outer wall portion having a structure for attachment of advertising matter.

2. The device as in claim 1 wherein said channel is of annular shape.

3. The device as in claim 1 wherein said outer wall portion is of annular shape.

4. The device as in claim 1 wherein said structure of said outer wall portion having an upper retainer projection and a lower retainer projection.

5. The device as in claim 1 wherein said outer wall portion having an upper retainer projection and said base adjacent said outer wall portion having a lower retainer projection.

6. The device as in claim 1 wherein there is a slot in said adjoining wall portion for insertion of advertisement.

7. A device to hold food items on a table having an upstanding projection therefrom comprising:

a pair of tray elements wherein each tray element having an interlocking element of an approximately semicircular cross section lip on a first portion of an upper edge of an adjoining wall portion of a wall attached to a base;

said adjoining wall portion having a centrally disposed channel that forms an aperture when said tray elements are interlocked;

said device assembled by interlocking said channel interlocking element of each of said tray elements to a second portion of said upper edge;

an outer wall portion of said wall attached to said base forming a compartment; and said base having an annular rail attached on a bottom thereof positioned for said annular rail to engage a bearing assembly attached to a pad.

8. The device as in claim 7 wherein said pad having a centrally disposed pad aperture.

9. The device as in claim 7, wherein said bearing assembly having a plurality of ball bearings.

* * * * *